US007886445B2

(12) United States Patent
Constantine et al.

(10) Patent No.: US 7,886,445 B2
(45) Date of Patent: Feb. 15, 2011

(54) CUTTING IMPLEMENT WITH CARTRIDGE

(75) Inventors: Richard Steven Constantine, Milford, CT (US); Michael E. Peterson, Fairfield, CT (US); Javier Verdura, Milford, CT (US); Jonathan A. Lee, Milford, CT (US); Cody Man For Ma, New Territories (CN)

(73) Assignee: Acme United Corporation, Fairfield, CT (US)

( * ) Notice: Subject to any disclaimer, the term of this patent is extended or adjusted under 35 U.S.C. 154(b) by 726 days.

(21) Appl. No.: 11/728,655

(22) Filed: Mar. 26, 2007

(65) Prior Publication Data

US 2007/0227012 A1 Oct. 4, 2007

Related U.S. Application Data

(60) Provisional application No. 60/789,530, filed on Apr. 4, 2006.

(51) Int. Cl.
*B26B 1/08* (2006.01)

(52) U.S. Cl. ..... 30/162; 30/125; 30/335

(58) Field of Classification Search ..... 30/151–162, 30/224, 225, 335, 125, 535–536, 124, 25; 16/423

See application file for complete search history.

(56) References Cited

U.S. PATENT DOCUMENTS

| | | | | | |
|---|---|---|---|---|---|
| 2,172,072 | A * | 9/1939 | Rothschild | ..... | 30/158 |
| 3,577,637 | A * | 5/1971 | Braginetz | ..... | 30/162 |
| 4,517,741 | A * | 5/1985 | Castelluzzo | ..... | 30/162 |
| 4,813,132 | A * | 3/1989 | Castelluzzo | ..... | 30/162 |
| 5,301,428 | A * | 4/1994 | Wilcox | ..... | 30/162 |
| 5,322,001 | A | 6/1994 | Boda | | |
| 5,404,645 | A * | 4/1995 | Janser | ..... | 30/125 |
| 5,495,670 | A * | 3/1996 | Quinn | ..... | 30/162 |
| 5,870,828 | A | 2/1999 | Polites | | |
| 5,966,817 | A * | 10/1999 | Lee | ..... | 30/162 |
| D420,270 | S | 2/2000 | Martone | | |
| 6,101,721 | A * | 8/2000 | Medhurst | ..... | 30/125 |
| 6,192,589 | B1 | 2/2001 | Martone et al. | | |
| 6,374,497 | B1 * | 4/2002 | Sun | ..... | 30/162 |
| 6,415,514 | B1 | 7/2002 | Chun | | |
| 6,446,340 | B1 * | 9/2002 | Ping | ..... | 30/125 |
| 6,553,674 | B1 * | 4/2003 | Budrow | ..... | 30/162 |

(Continued)

*Primary Examiner*—Laura M. Lee
(74) *Attorney, Agent, or Firm*—Alix, Yale & Ristas, LLP

(57) ABSTRACT

A utility knife has a receiving cavity which opens through the body. A cartridge comprising a magazine of blades is removably insertable into the receiving cavity. A carrier within the body is manually operable for receiving a blade from the cartridge and positioning the blade for extension through the opening to present a cutting edge. The cartridge may be released from the utility knife body by depressing a button and withdrawing the cartridge. The cartridge is releasably held in place within the knife body and releasable when the blade carrier is in its retracted position and the release button is depressed. When the thumb button moves the blade carrier into its extended position to expose the knife blade, the cartridge is rendered unreleaseable even if the release button is depressed. The release button, which will enable removal of the magazine when depressed and blade carrier is in its retracted position, also serves to release of the blade from the blade carrier to permit removal of a used blade from the knife body when the blade carrier is in its extended position.

12 Claims, 17 Drawing Sheets

U.S. PATENT DOCUMENTS

| | | | | |
|---|---|---|---|---|
| 6,637,308 | B2 | 10/2003 | Nichols et al. | |
| 6,829,827 | B2 * | 12/2004 | Tseng | 30/162 |
| 7,448,136 | B2 * | 11/2008 | Huang | 30/125 |
| 7,533,467 | B2 * | 5/2009 | Fossella | 30/162 |
| 2005/0050734 | A1 | 3/2005 | Kesinger | |
| 2005/0150116 | A1 | 7/2005 | Johnson et al. | |
| 2005/0204567 | A1 * | 9/2005 | Ping | 30/161 |
| 2007/0074402 | A1 * | 4/2007 | Hernandez et al. | 30/162 |

* cited by examiner

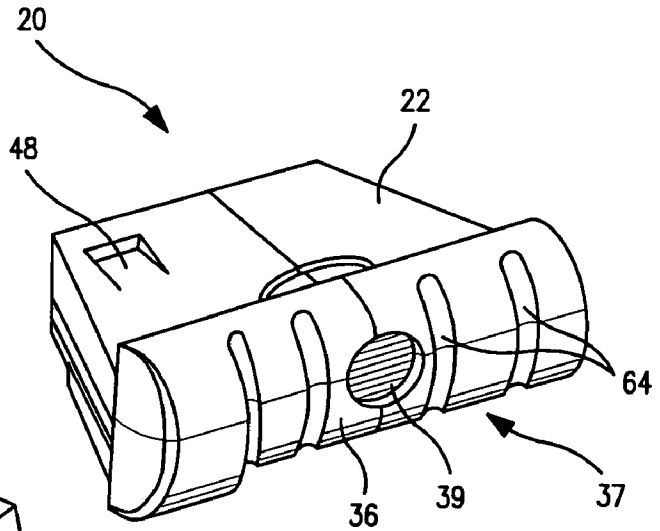
Fig. 5A
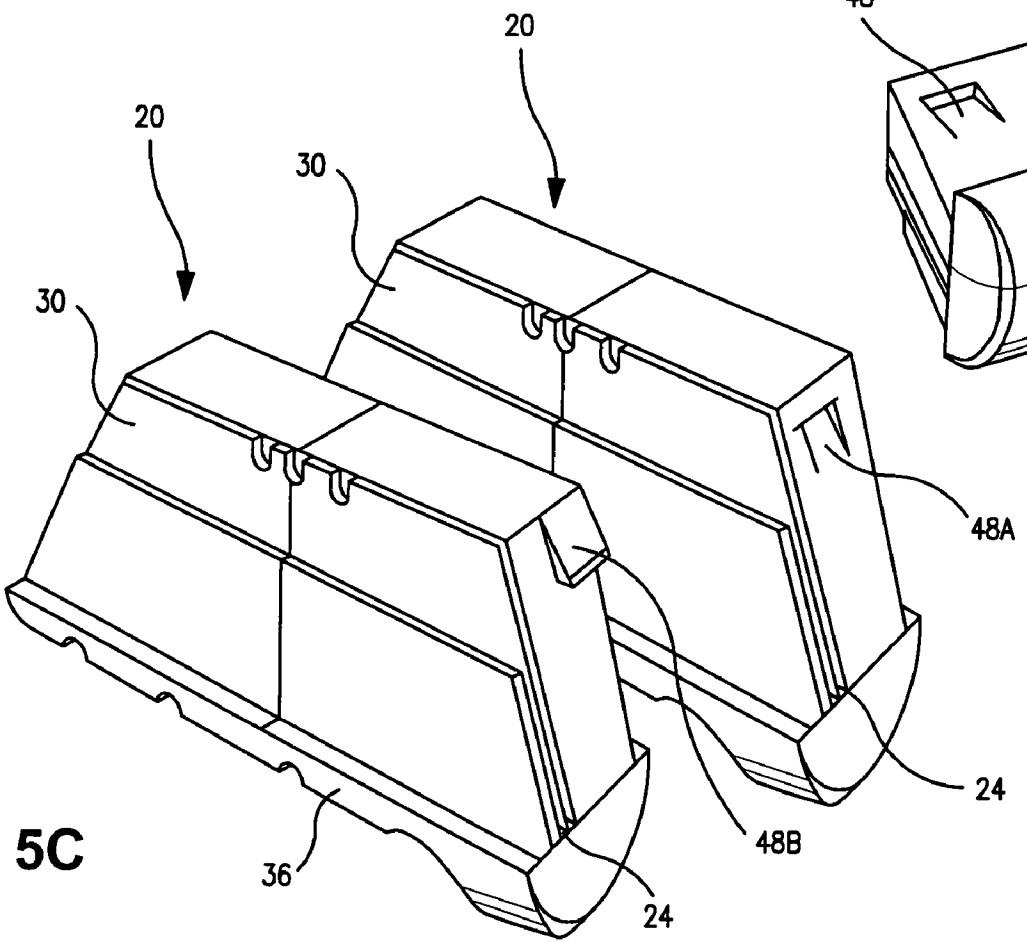
Fig. 5B
Fig. 5C

CUTTING IMPLEMENT WITH CARTRIDGE

CROSS REFERENCE TO RELATED APPLICATION

This application claims the priority of U.S. Patent Application No. 60/789,530 filed on Apr. 4, 2006.

TECHNICAL BACKGROUND

This invention relates generally to blade loading systems for trimming and cutting devices. More particularly, this invention relates to knives which are loadable with a plurality of blades for sequential sliding movement to a forward position to present a cutting edge for usage.

SUMMARY

Briefly stated, a knife comprises a body having a handle portion with a frontal opening for a blade and a receiving cavity opening through the body. A cartridge comprising a magazine of blades is insertable into the receiving cavity. A carrier is manually operable for receiving the blade from the cartridge and positioning the blade for extension through the opening to present a cutting edge. A button projects through the body and is manually depressable to release the blade from the carrier to permit withdrawal forwardly from the opening. The button may also be depressable to allow the cartridge to be withdrawn from the body.

The cartridge forms a receptacle for receiving a plurality of blades and the receptacle defines a detent which interacts to secure the cartridge to the body. A pivoted lever arm mounted interiorally to the body at one end connects to the button and a second end engages the cartridge to retain the cartridge in the body. The cartridge has an exterior surface which mates with a body upon reception in the receiving cavity. A window opens through the exterior surface to allow visual inspection of blades in the cartridge. The cartridge has a frame and a cover which snaps into the frame to capture the blades. A biasing member may be mounted into the interior of the cover. The frame and cover prevent direct contact with cutting portions of the blades.

The blades are preferably substantially congruent and further include three notches in an upper location thereof. The blades may take various forms such as a trapezoidal shape, a hook-type shape or a hawk-type shape. To enhance versatility, a second cartridge has a magazine of blades with a different configuration from those of the first cartridge.

The cartridge may be a molded member. An overmold substantially defines the exterior of the knife body. In one embodiment, the cover further comprises a plurality of projections which form a one time lock with the frame.

According to another aspect a utility knife is provided which comprises a body having a handle portion and a frontal opening for a blade and a receiving cavity opening into body. A cartridge containing a plurality of blades is insertable into said receiving cavity. The cartridge has front and rearward tabs. A blade carrier is manually operable for receiving a blade from said cartridge and moveable into an extended position to position said blade through said opening into a cutting position. The front and rearward cartridge catches are adapted to releaseably engage said tabs to secure said cartridge in said body.

BRIEF DESCRIPTION OF THE DRAWINGS

FIGS. 5A, 5B, and 5C are perspective views of the blade cartridge of FIG. 4 from the various sides thereof and illustrating various cartridge embodiments;

DETAILED DESCRIPTION OF THE PREFERRED EMBODIMENT

Figure 1:
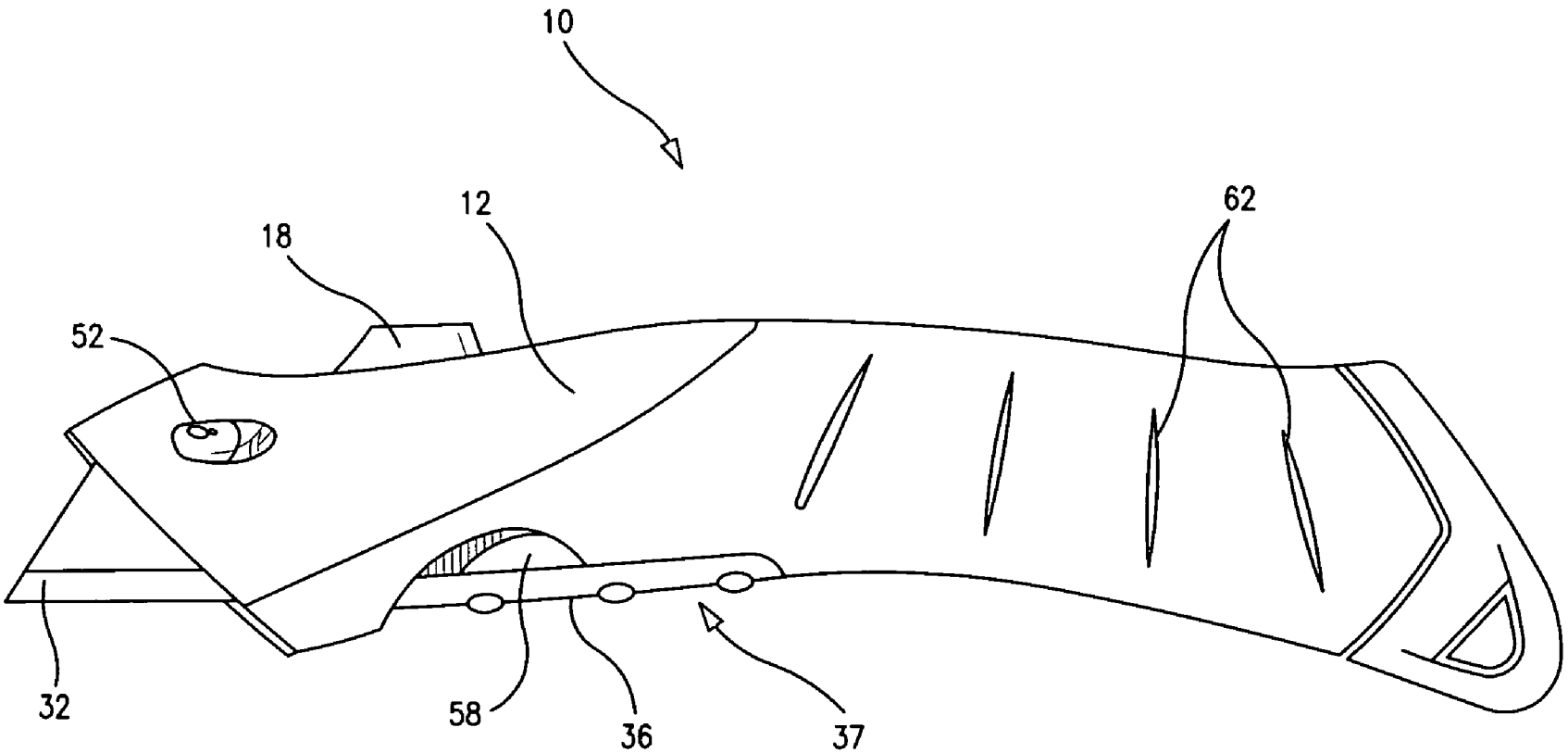
FIG. 1 is a side elevational view of a utility knife.
Figure 2:
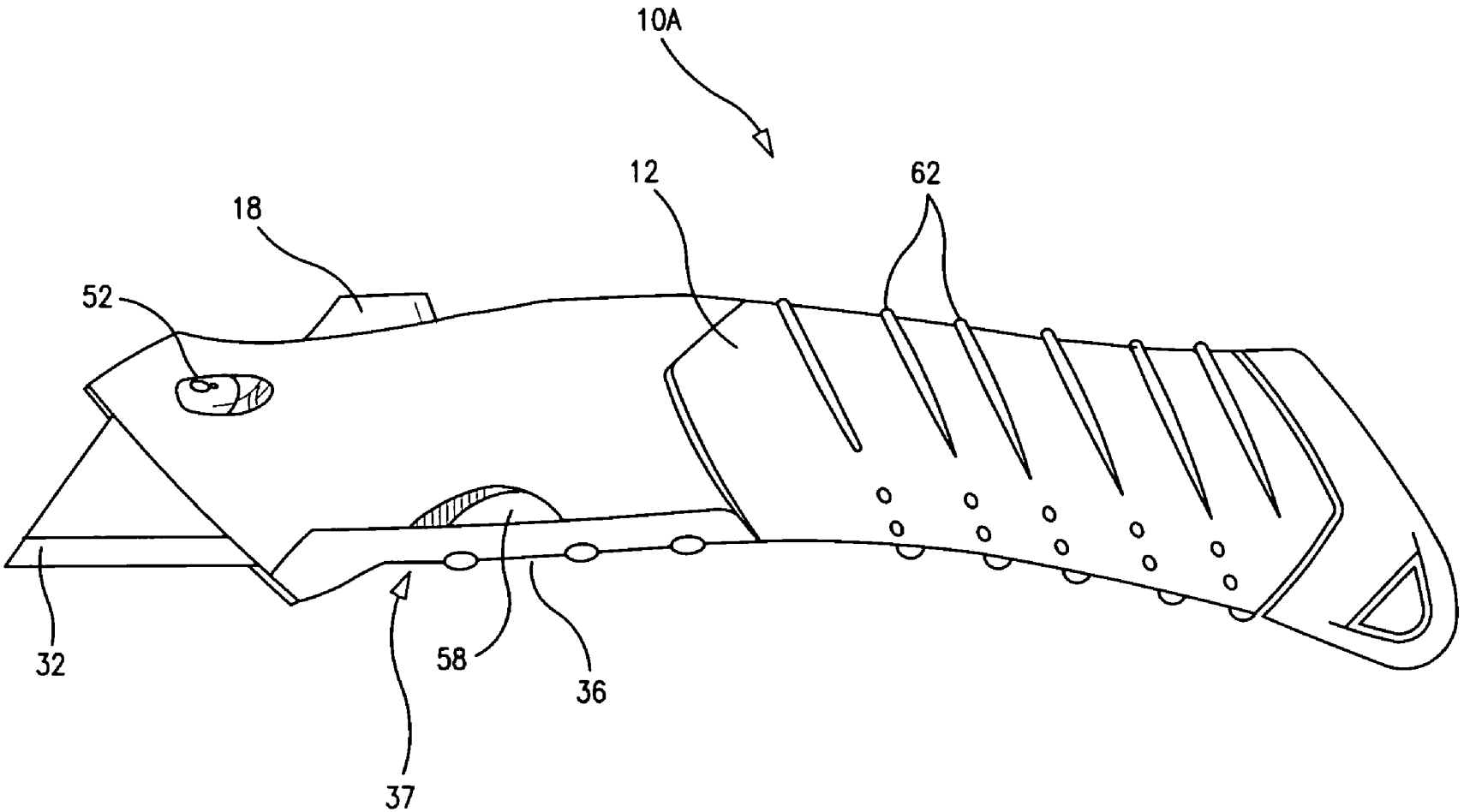
FIG. 2 is a side elevational view of a second embodiment of a utility knife.
Figure 10:
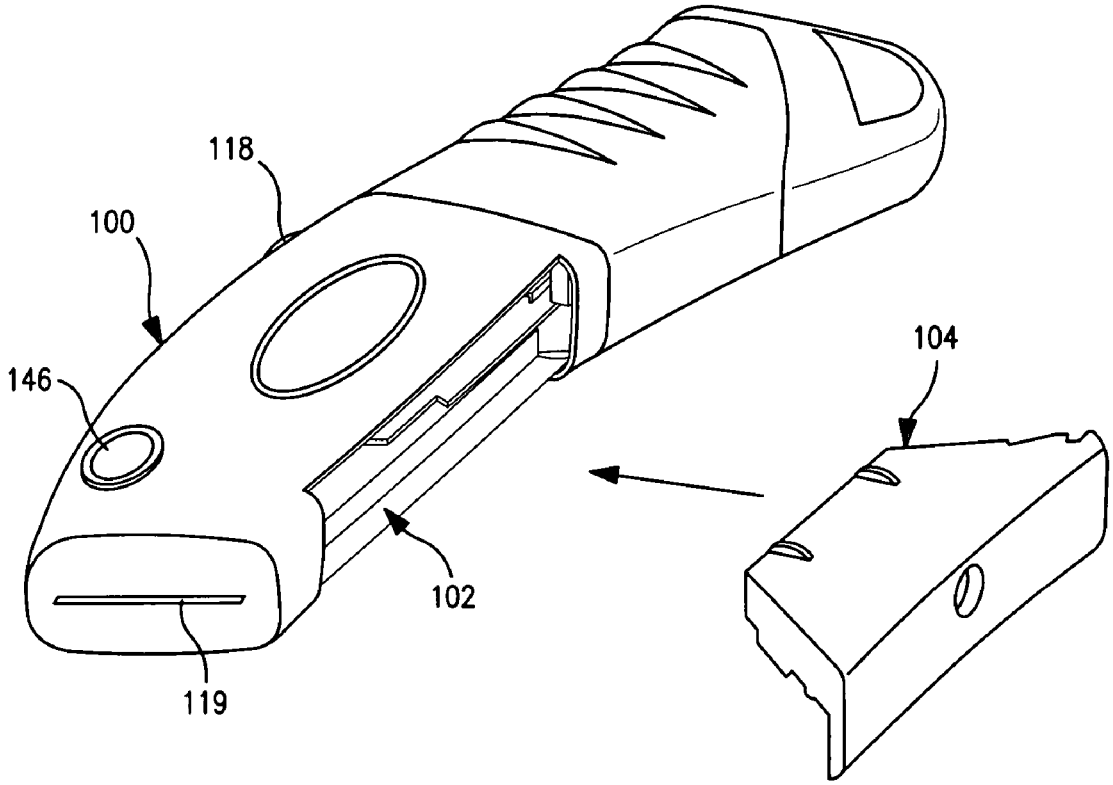
FIG. 10 is an isometric side view of a second aspect of a utility knife showing the knife body and removable cartridge.

With reference to the drawings wherein like numerals represent like parts throughout the several Figures, a utility knife is designated with the numeral 10 in FIG. 1 and 10A in FIG. 2. The utility knife 10 receives a cartridge 20 comprising a sealed magazine of blades 30 which are sequentially projectable to a forward position to present a cutting edge 32 extending forwardly from the knife body 12.

Figure 3:
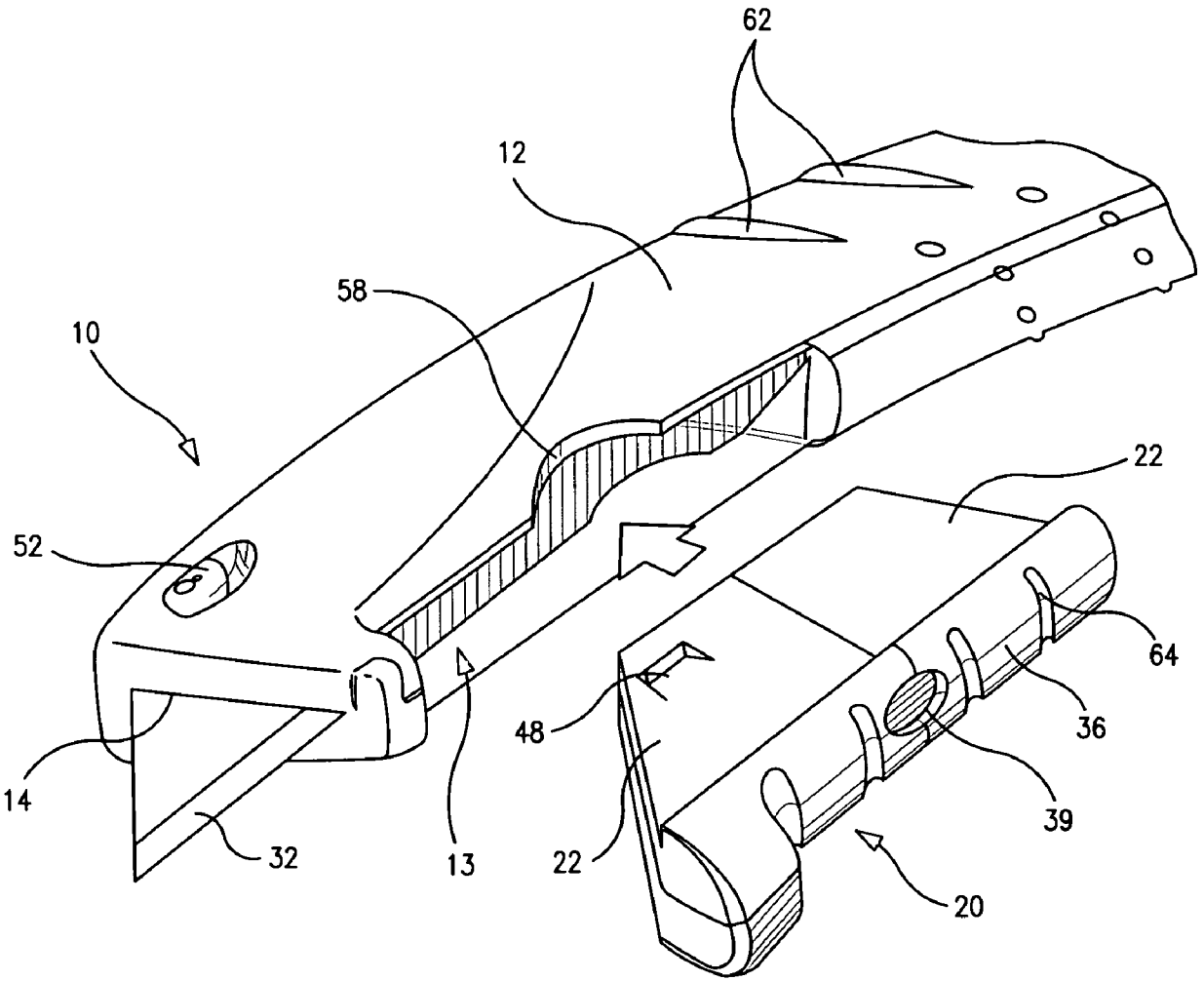
FIG. 3 is an exploded perspective view, partly in schematic, of the utility knife of FIG. 1.

The knife body 12 includes a receiving cavity 13 which is dimensioned and configured to complement the cartridge 20 as best illustrated in FIG. 3. The receiving cavity 13 in the illustrated embodiment has an underside access opening so that the cartridge may be inserted through the access opening (shown by the arrow) into the knife body and snapped into a secure retention therewith.

Figure 8:
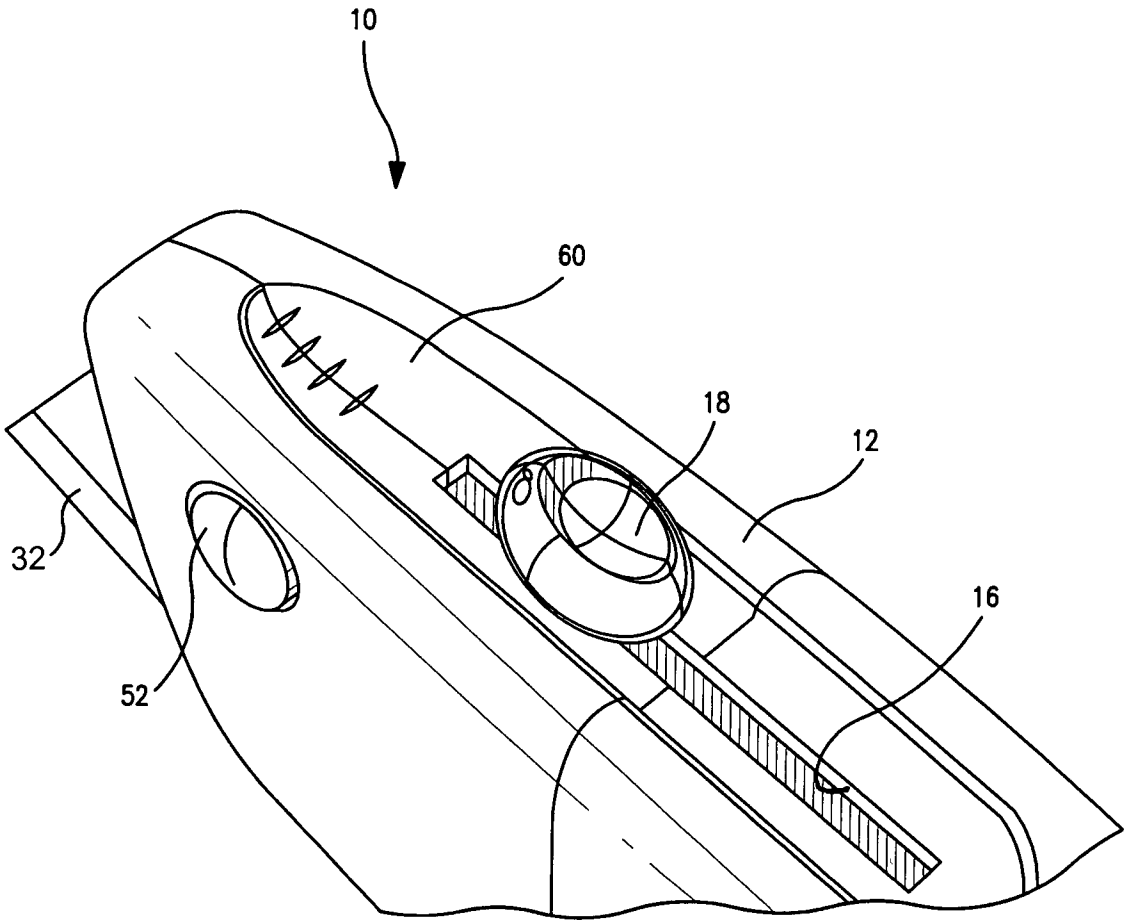
FIG. 8 is a fragmentary enlarged perspective view illustrating a forward top frontal portion of the utility knife of FIG. 1.

At the interior of the knife body 12, a blade carrier (not illustrated) is configured for sequentially receiving a blade and sliding longitudinally in the body to project the blade through a frontal opening 14 of the utility knife to present a cutting edge 32. The carrier includes locating tabs (not illustrated) which mate with notches 34 of the blade to allow the innermost blade to be projected by the carrier. The upper body of the utility knife includes a longitudinal slot 16 (FIG. 8) which receives a resilient finger-like projection connecting the carrier and includes a button 18 to allow the carrier to be moved by the user's thumb to the forward cutting position (shown in FIGS. 1, 2, 3 and 8) and to retract the blade into the housing formed by the body.

Figure 6:
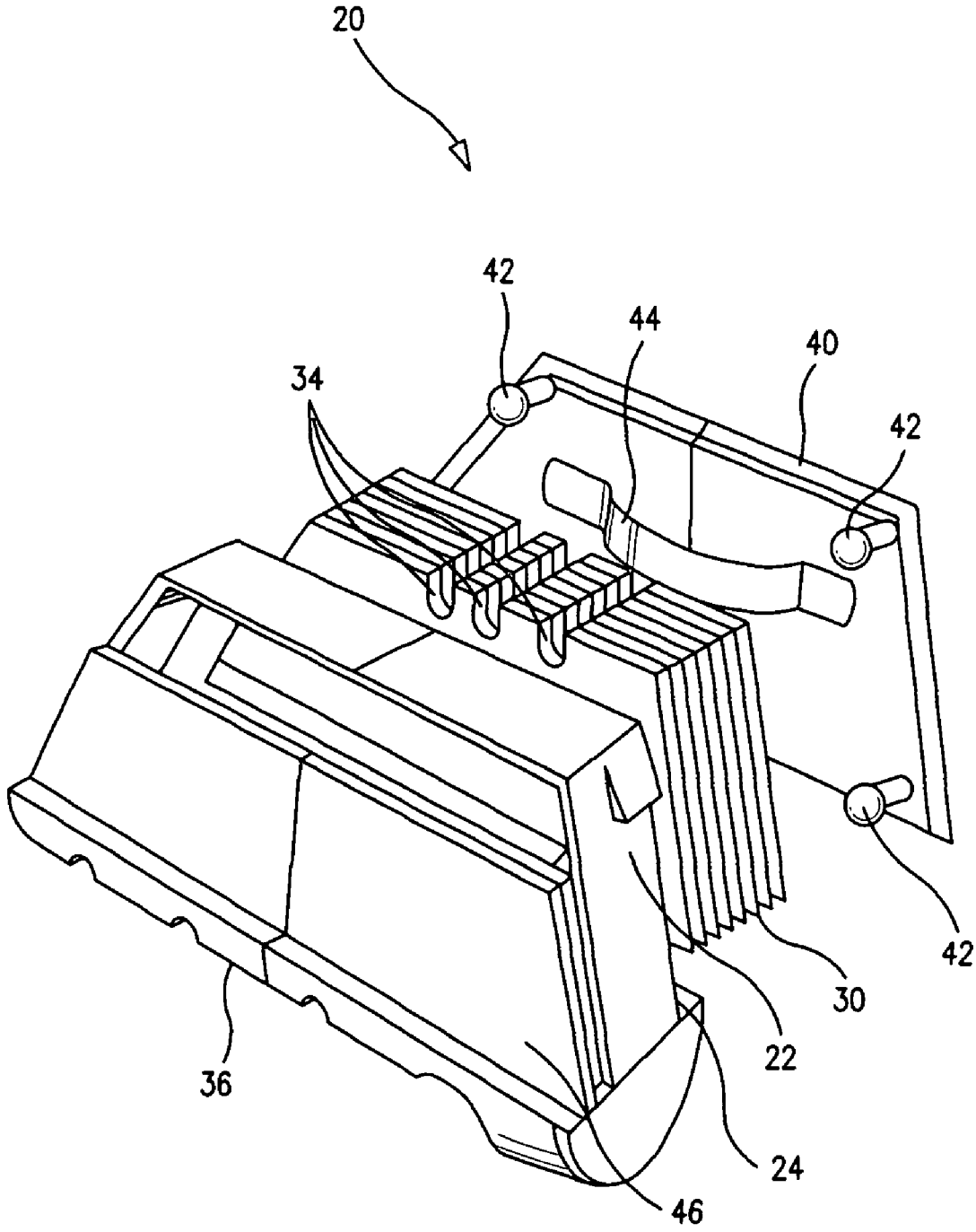
FIG. 6 is an exploded perspective view of a blade cartridge of FIG. 5.
Figure 7:
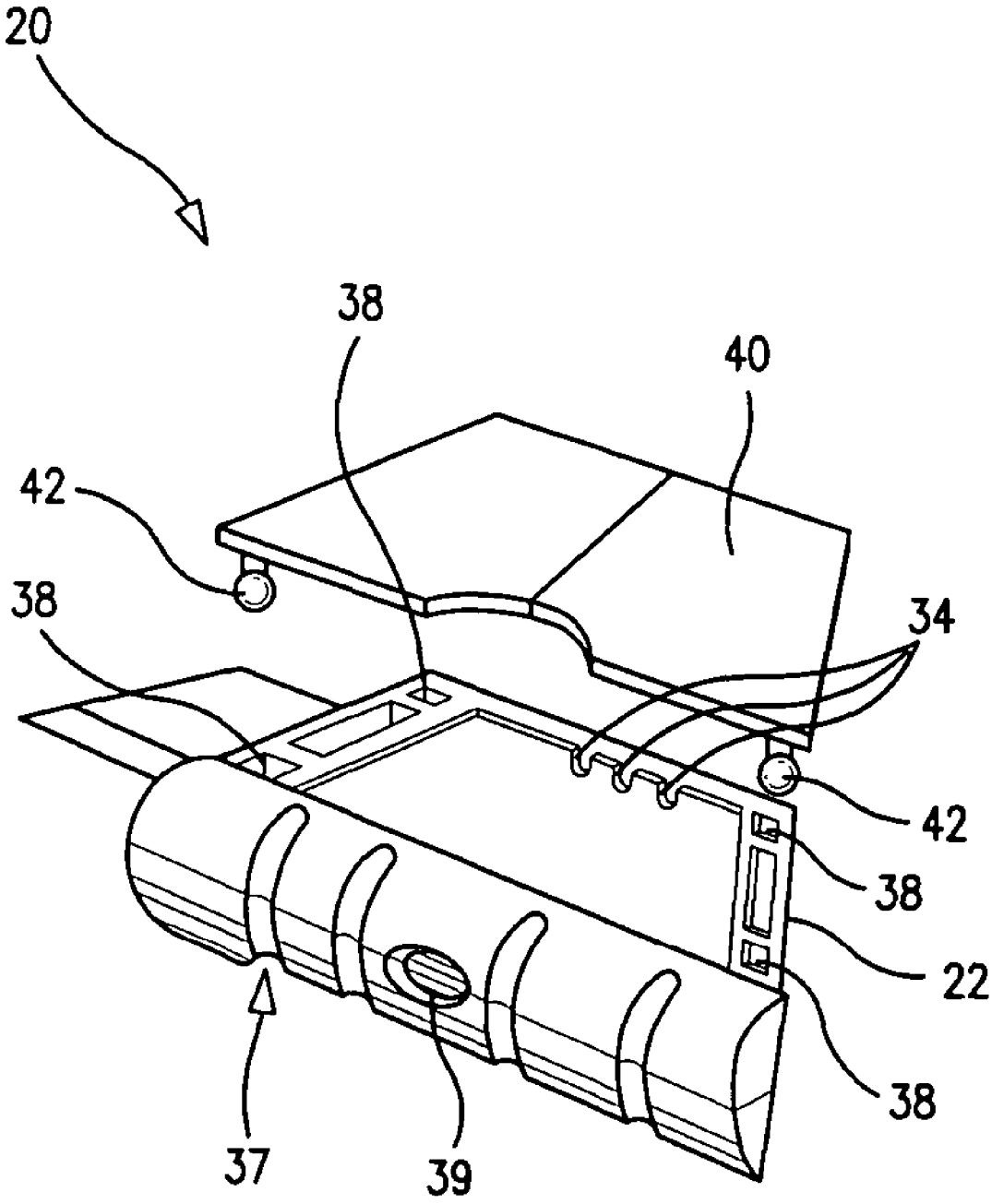
FIG. 7 is a second perspective view of the cartridge of FIG. 5 from a generally opposite location thereof.

The cartridge 20 may assume various forms such as illustrated in FIGS. 3 and 5A. The cartridge 20 includes a receptacle (trapezoidal as illustrated) frame 22 for receiving and protecting the blades 30 which preferably have three notches 34 at the upper portions thereof. The cutting edges 32 of the blades engage a platform 24, the other side of which forms a portion of the underside surface 36 of the knife body upon the mounting of the cartridge into the blade or cartridge-receiving cavity 13. A cover plate 40 (FIGS. 6 and 7) includes four one-way tree extensions 42 which snap into openings 38 of the frame. The inner side of the cover plate includes an integrated spring 44 which bears against the outermost blade and urges the blades toward the stop plate 46. Once the cover 40 is snapped into place, the blades are captured within the cartridge and the edges are sealed therewith so that access to the exposed cutting edges 32 is prevented prior to loading the cartridge in the cavity.

Figure 4:
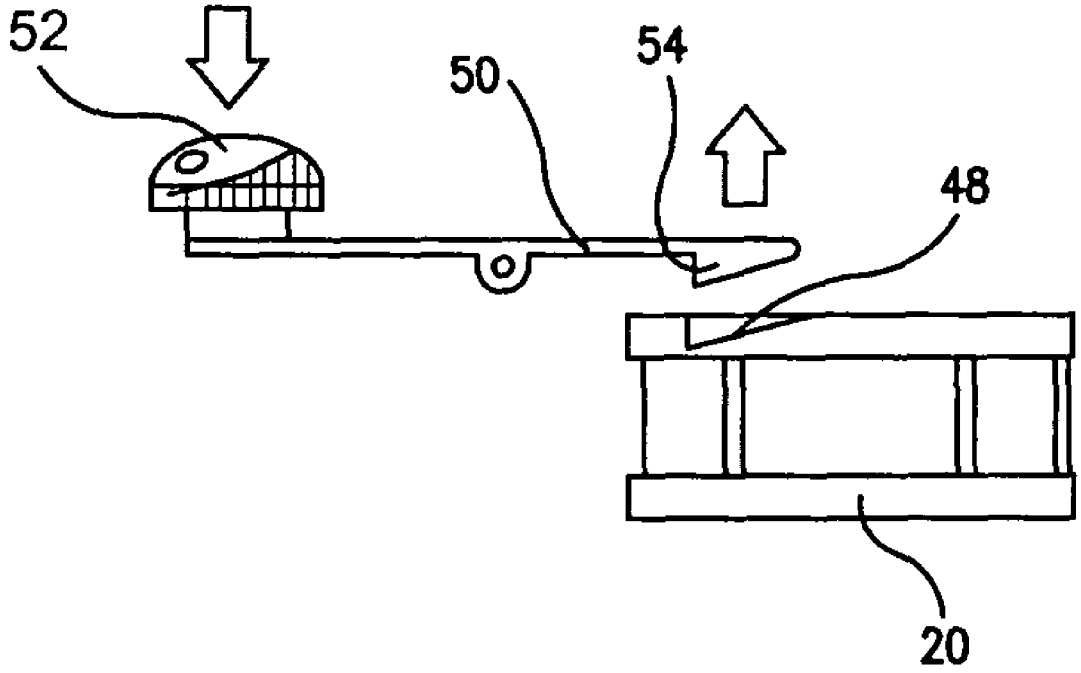
FIG. 4 is an interior bottom plan view, partly in schematic, illustrating a sub-assembly of the utility knife of FIG. 3.

In one embodiment, a release catch in the form of a detent 48 is positioned at the side of the cartridge. With reference to FIG. 4, a pivoted lever arm 50 is actuatable by a front button 52 and is pivotable so that the distal end of the lever arm has a latch 54 which engages in the detent 48 to removably secure the cartridge. The cartridge retaining structure may have other forms and alternative positions, such as retainers or catches 48A and 48B, (illustrated in FIGS. 5B and 5C).

Upon insertion of the cartridge 20 into the knife body 12, the underside surface 36 of the cartridge is integrated with the contoured surface of the body and the handle and includes a molded contoured grip portion 37 to facilitate gripping and usage of the knife. In addition, a window 39 is formed at the underside to allow viewing of the number of blades remaining in the cartridge.

The utility knife 10, 10A functions in a highly efficient and safe manner. The cartridge 20 with the blade magazine is inserted into the receiving cavity 13 of the knife body. The finger button 18 may be employed so that the carrier receives the innermost blade and the finger button is moved to force the blade through the frontal opening 14 to the cutting position. When it is desired to replace the blade, the frontal button 52 is depressed which forces the notches 34 to disengage from the carrier retention tabs and allows the blade to be forwardly removed from the utility knife body. The finger button 18 may then be retracted to pick up a new blade from the blade magazine which is forced against the carrier by the spring 44 of the magazine. The newly received blade is then projected to the forward position.

It will be appreciated that the button 52 in some embodiments functions to both allow for ejection of the used blade and to release the cartridge for removal from the knife blade body. When it is desired to replace the cartridge 20 entirely, there will be no blade in the cartridge and in the blade channel and accordingly pressing the button 52 will allow release of the lever 50 to pivot and force the latch 54 to disengage from the detent 48 and the cartridge 20 to be manually removed from the blade body as schematically illustrated in FIG. 4. An arcuate depression 58 in the body provides finger access for removing the spent cartridge.

The knife body preferably has a smooth contoured, aesthetically pleasing appearance with an overmold or outer layer which is configured to facilitate gripping and usage of the utility knife. The outer layer is formed of a resilient and/or flexible polymer material, such as TPE. The material may be overmolded over a rigid body portion which may be metal or an appropriate polymer such as ABS. The outer layer may be formed by an injection molding process or any other similar process used in the art. In addition, a finger channel 60 is formed at the upper portion around the longitudinal extant of the slot 16. The finger channel 60 is also provided with an overmold outer surface to facilitate usage of the utility knife.

Ribs 62 and grooves 64 molded to form exterior surface contours are conformably engaged by the hand during usage. The ribs and grooves provide increased resiliency in areas of contact creating a cushioning effect that relieves pressure on the hand and fingers during usage, thereby reducing fatigue and increasing comfort. The increased resiliency helps maintain the grip and facilitates cutting precision.

Figure 9A:
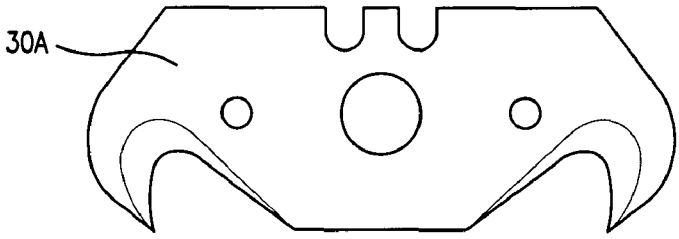
FIG. 9A-9C are side views of alternative blade embodiments for the various utility knives.
Figure 9B:
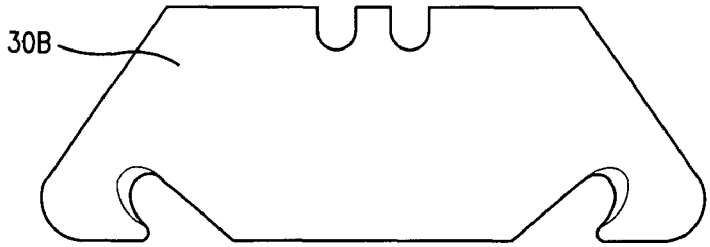
Figure 9C:
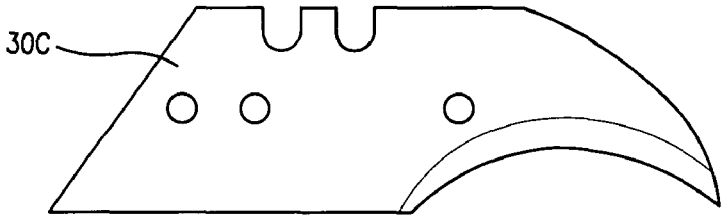

In the illustrated embodiment the cartridge 20 is employed with a plurality of trapezoidal type cutting blades 30. However, with reference to FIGS. 9A-9C it should be appreciated that hawk-type blades 30A, hook-type blades 30B and other type cutting blades 30C may also be loaded into a given cartridge.

The cartridge provides a very efficient and quick means for replacing a new blade magazine upon usage of the spent blades. In addition, because of the sealed package feature, the cartridge and the blades can be handled and loaded into the utility knife without the user's exposure to the cutting edges of the blades.

It should be appreciated that in some embodiments the cartridge could be loaded from the side and snapped into position.

Figure 11:
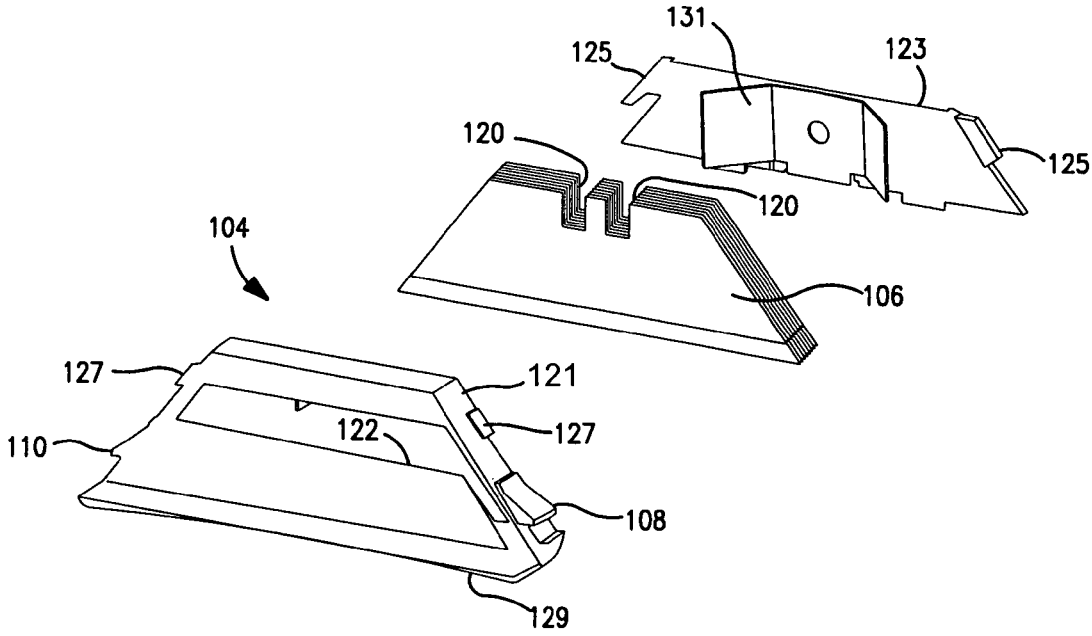
FIG. 11 is an exploded view of the blades and cartridge of the aspect shown in FIG. 10.
Figure 12:
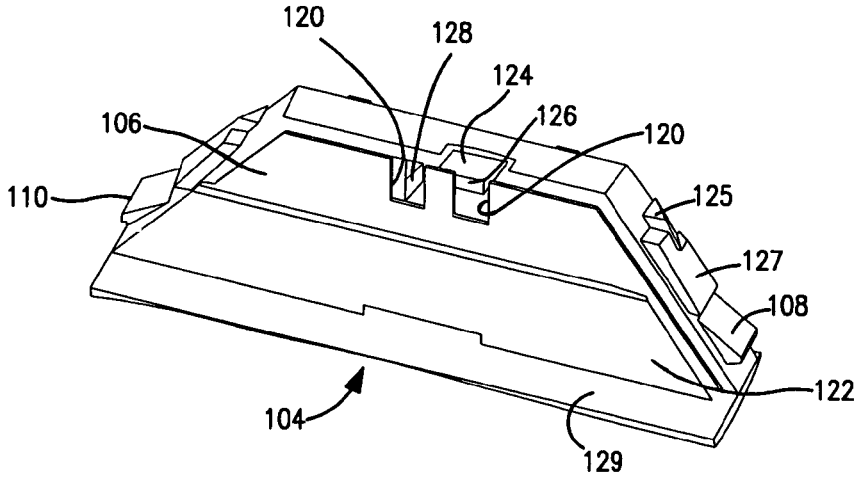
FIG. 12 is an isometric view of the assembled blades and cartridge of FIG. 11.
Figure 13:
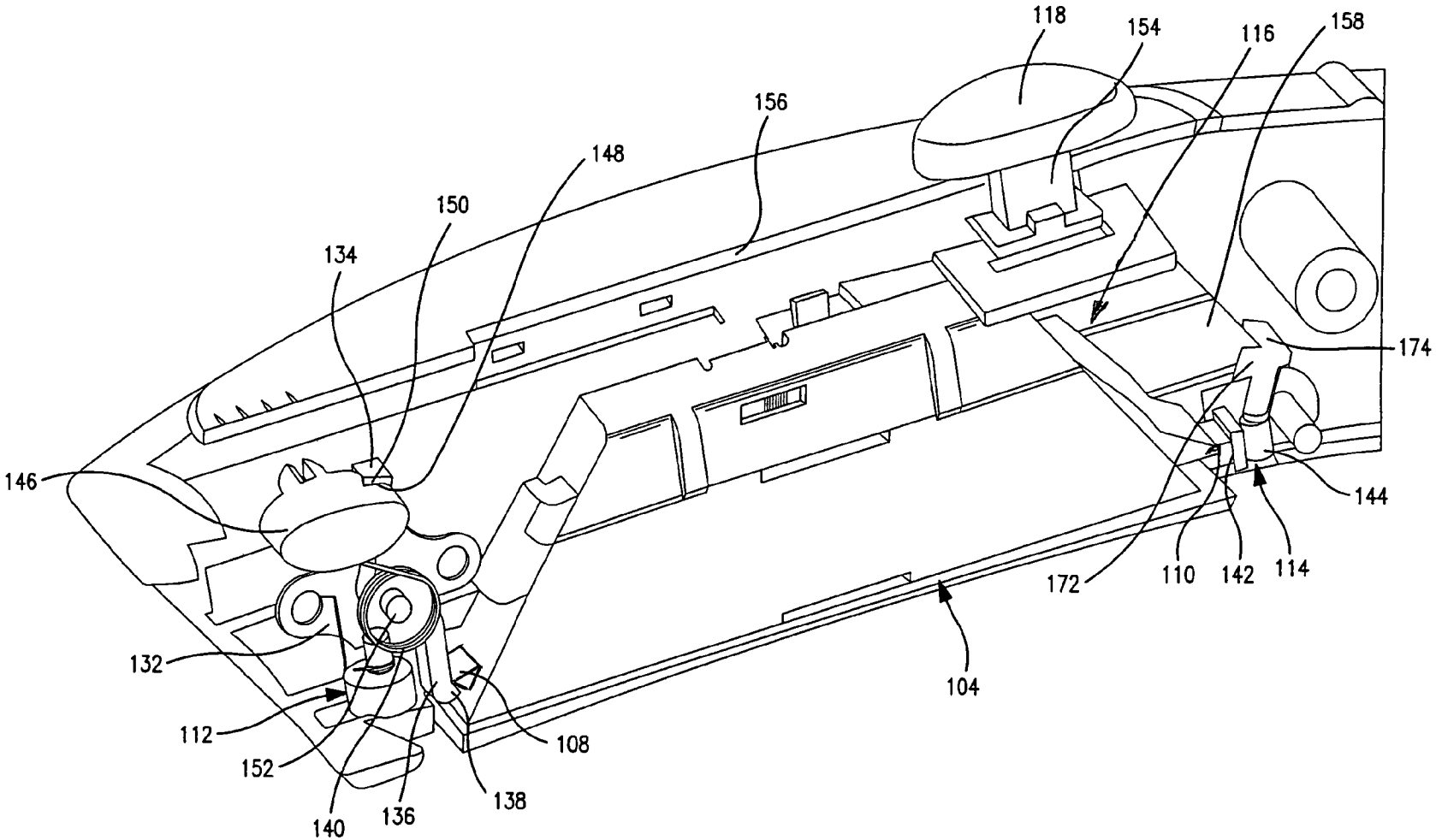
FIG. 13 is a partial sectional view of the knife body and inserted cartridge with the opening in the knife body for the blade to be exposed being to the left as view in the Figure.

In accordance with another aspect shown in FIGS. 10-15, a utility knife body 100 has an opening 102 in its bottom edge for reception of a cartridge 104 having a plurality of blades 106 therein. The cartridge 104 includes a front tab 108 on its front end and a rear tab 110 on its rearward end that are adapted to be releasably engaged respectively by a front cartridge catch 112 and a rear cartridge catch 114 in the knife body 100 as shown in FIG. 13. The cartridge 104 is adapted to be inserted in the bottom edge of the knife body 100 and locked in a position by the front and rear cartridge catches 112 and 114 whereby a blade 106 in the cartridge 104 can be engaged by a blade carrier 116 and moved forward by movement of the a thumb button 119 to extend from the forward opening 119 in the knife body 100 to present a cutting edge.

As shown in FIG. 11 the blades 106 include two spaced notches 120 extending downwardly from their top edges. The cartridge 104 is generally trapezoidal and includes a frame 121 in which the blades are positioned including a stop plate 122 against which the outer most blade 106 rests. A back cover 123 is attached to the frame 121 by fingers 125 that snap over side tabs 127 on the frame 121 or other suitable connections. The frame 121 includes a base 129, the bottom surface of which forms a portion of the undersurface of the knife body 100 when the cartridge 104 is inserted into the knife body 100. A spring 131 is attached to the inside of the back cover 123 to urge the blades 106 toward the stop plate 122 in a position for the outermost blade 106 to be engaged by the blade carrier 116. For the purposes of this aspect, the outermost blade is the blade positioned against the stop plate 122 of the cartridge 104. The cartridge 104 includes a breakaway tab 124 that extends over one of the notches 120 in the blades 106 with a portion 126 projecting downwardly into the notch 120 as shown in FIG. 12. A tab 128 extends from the inner wall of the cartridge 104 into the other of the notches 120, terminating short of the inner wall of the outermost blade 106. The breakaway tab 124 serves to contain the blades 106 within the cartridge 104 during handling. When it is desired to use the cartridge 104, the tab 124 is broken away just before the cartridge 104 is inserted into the knife body 100.

Figure 14:
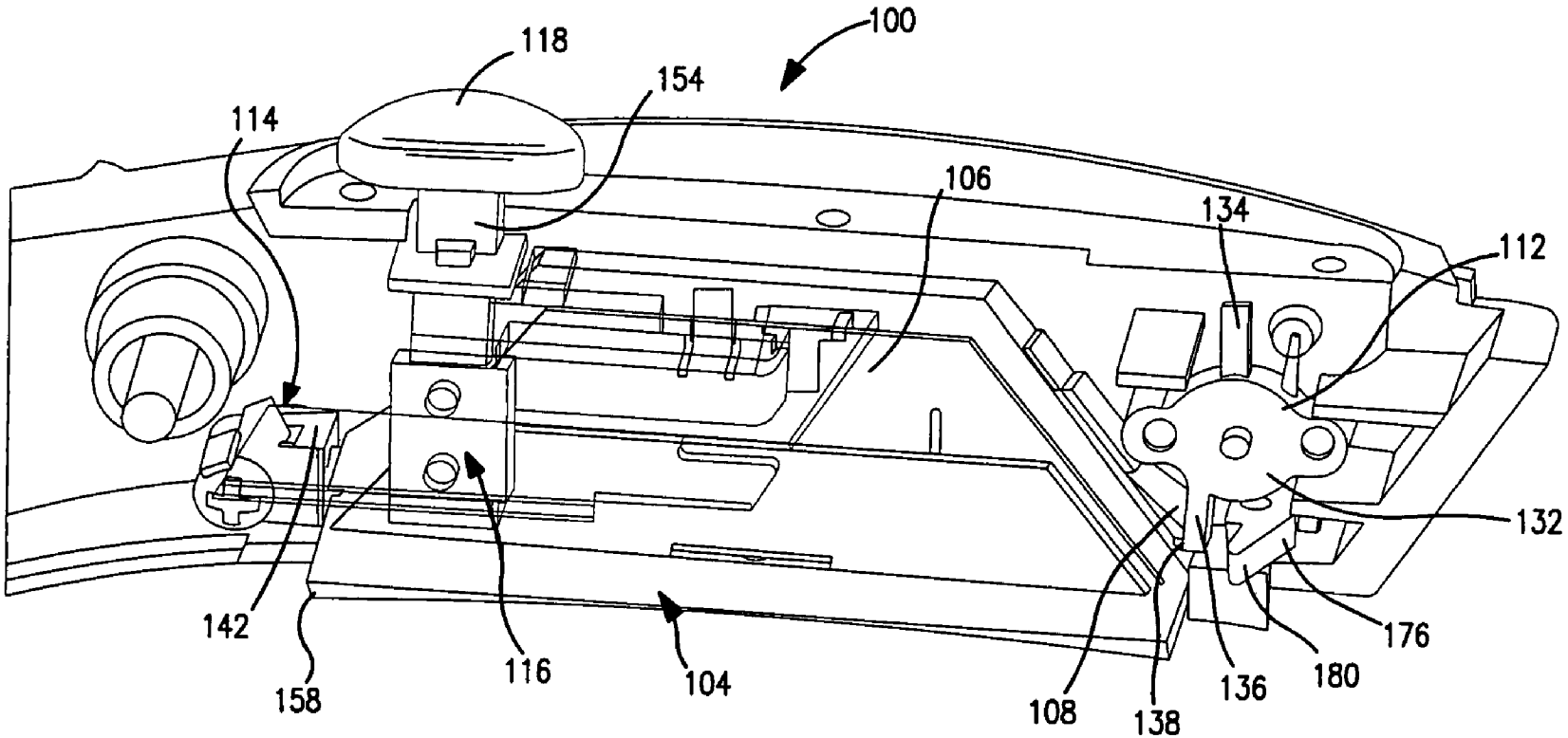
FIG. 14 is a partial sectional view of the knife body and cartridge with the opening in the knife body for the blade to be exposed being to the right as view in the Figure.

As shown in FIGS. 13 and 14, the front cartridge catch 112 comprises a pivotable member 132 having an upstanding arm 134 and a downwardly extending arm 136 terminating in a hook 138 adapted to engage the tab 108 on the front end of the cartridge 104 as shown. A spring 140 biases the pivotable member 132 and hook 138 into the latching position in engagement with the tab 108. The rear cartridge catch 114 includes a locking slide 142 that is urged forwardly by a spring clip 144 into engagement with the rear tab 110 on the rearward end of the cartridge 104.

A release button 146 is mounted in the side of the knife body 100. The release button 146 is adapted to provide for release of the cartridge 104 when the blade carrier 116 is in its rearward position. In this connection, the release button 146 has a portion extending into the knife body 100 that has an inclined surface 148 thereon that is designed to mate with and engage an inclined surface 150 on the upstanding arm 134 of the pivotable member 132 of the front cartridge catch 112 as shown in FIG. 13. With this arrangement, pushing inwardly on the release button 146 to depress it moves the release button 146 in an axial direction perpendicular to the longitudinal axis of the of knife body 100 and parallel to the axis of rotation of the pivotable member 132 of the front cartridge catch 112. The interaction of the inclined surface 148 on the release button 146 and the inclined surface 150 on the upstanding arm 134 of the pivotable member 132 causes the pivotable member 132 to pivot about its pivot point 152 resulting in the downwardly extending arm 136 pivoting away form the front end of the cartridge 104. This causes the hook 138 at the end of the downwardly extending arm 136 to disengage from the front tab 108 on the cartridge 104.

With the release button 146 depressed and the hook 138 disengaged from the front tab 108 on the cartridge 104, the cartridge 104 may be grasped by the fingers and pulled outwardly. For this purpose, the knife body 100 may be provided with arcuate depressions 153 to provide finger access for grasping the cartridge 104. As it is being pulled outwardly, after the front end is free, the cartridge 104 may pulled slightly forward to release the rear tab 110 from the from the rear cartridge catch 114 and then completely removed.

When the cartridge 104 is inserted into the knife body 100, it is positioned so that the outermost blade 106 can be engaged by the blade carrier 116. The blade carrier 116 is moveable within the knife body 100 between a retracted position where it can engage a blade 106 in the cartridge 104 and a forward position wherein an engaged blade 106 projects from the forward end of the knife body 100 and presents a cutting surface. The blade carrier 116 is moveable between the two positions by the thumb button 118 positioned on the top side of the knife body 100 and connected to the blade carrier 116 by a connecting member 154 which extends through an elongated slot 156 in the top of the knife body 100. The blade carrier 116 includes a bracket member 158 to which is attached a spring clip 160.

Figure 16:
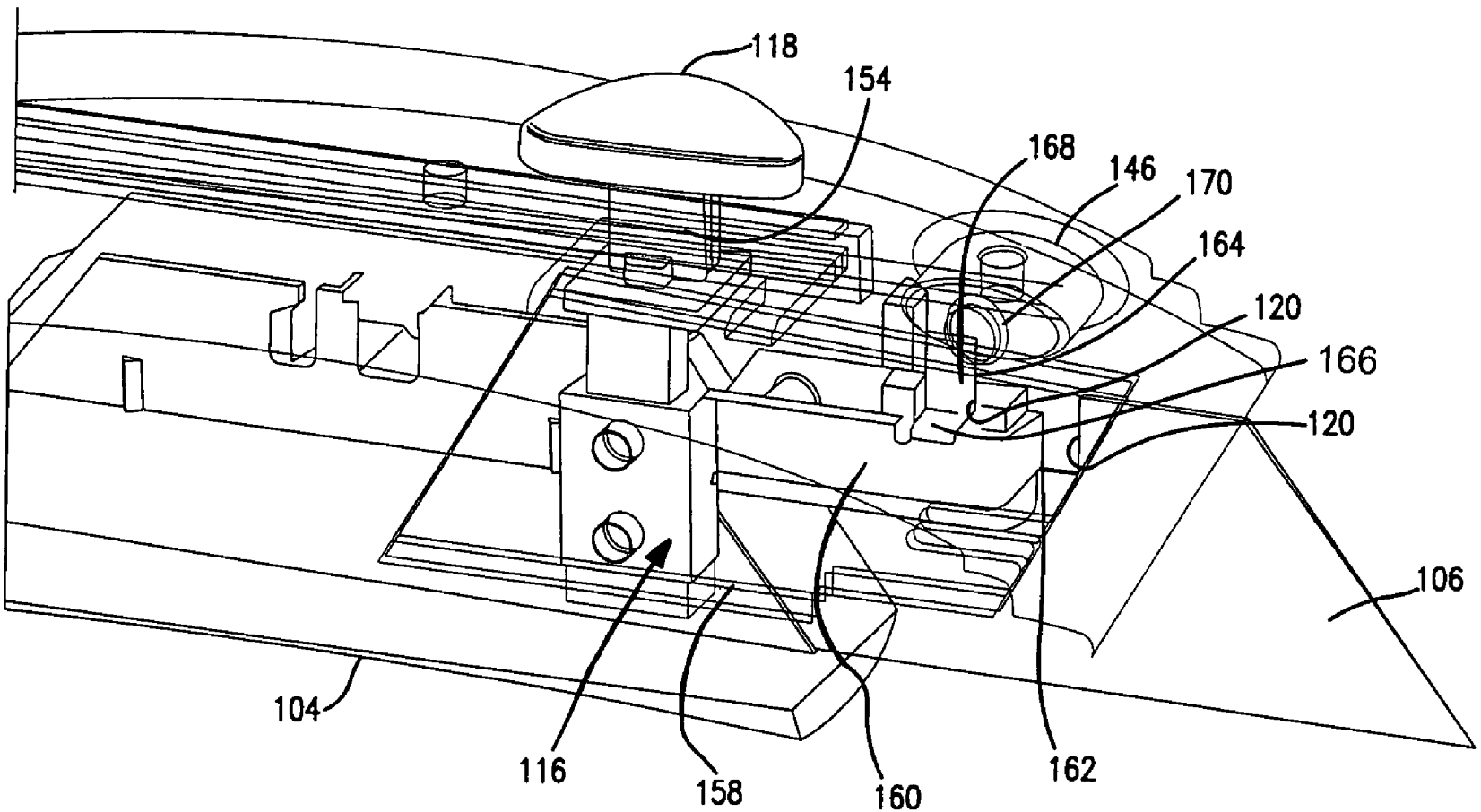
FIG. 16 is a partial sectional view similar to FIG. 14, but showing the thumb button and blade carrier in the extended position with the blade in a positioned to cut.

As shown particularly in FIG. 16, the spring clip 160 includes blade engaging elements in the form of a front blade engaging tab 162 that is generally perpendicular to the length of the blade, and a rearward blade engaging tab 164 which includes a horizontal portion 166 and an upstanding portion 168 which is angled inwardly toward the front of the knife body 100 as shown. The rearward blade engaging tab 164 projects into the rearward notch 120 in the blade 106 and engages the forward edge of the notch 120 to move the blade 106 forwardly when the blade carrier 116 is moved into the forward position. The angled upstanding surface 168 serves to move the tabs 162 and 164 out of the way as the blade carrier 116 is being retracted after a blade has been released so that the spring can pass over a blade 106 in the cartridge 104 as the carrier 116 is being retracted. The front tab 162 projects into the forward notch 120 in the blade 106 and serves to engage the blade 106 and pull the blade backward when the blade carrier 116 is being retracted.

Figure 15:
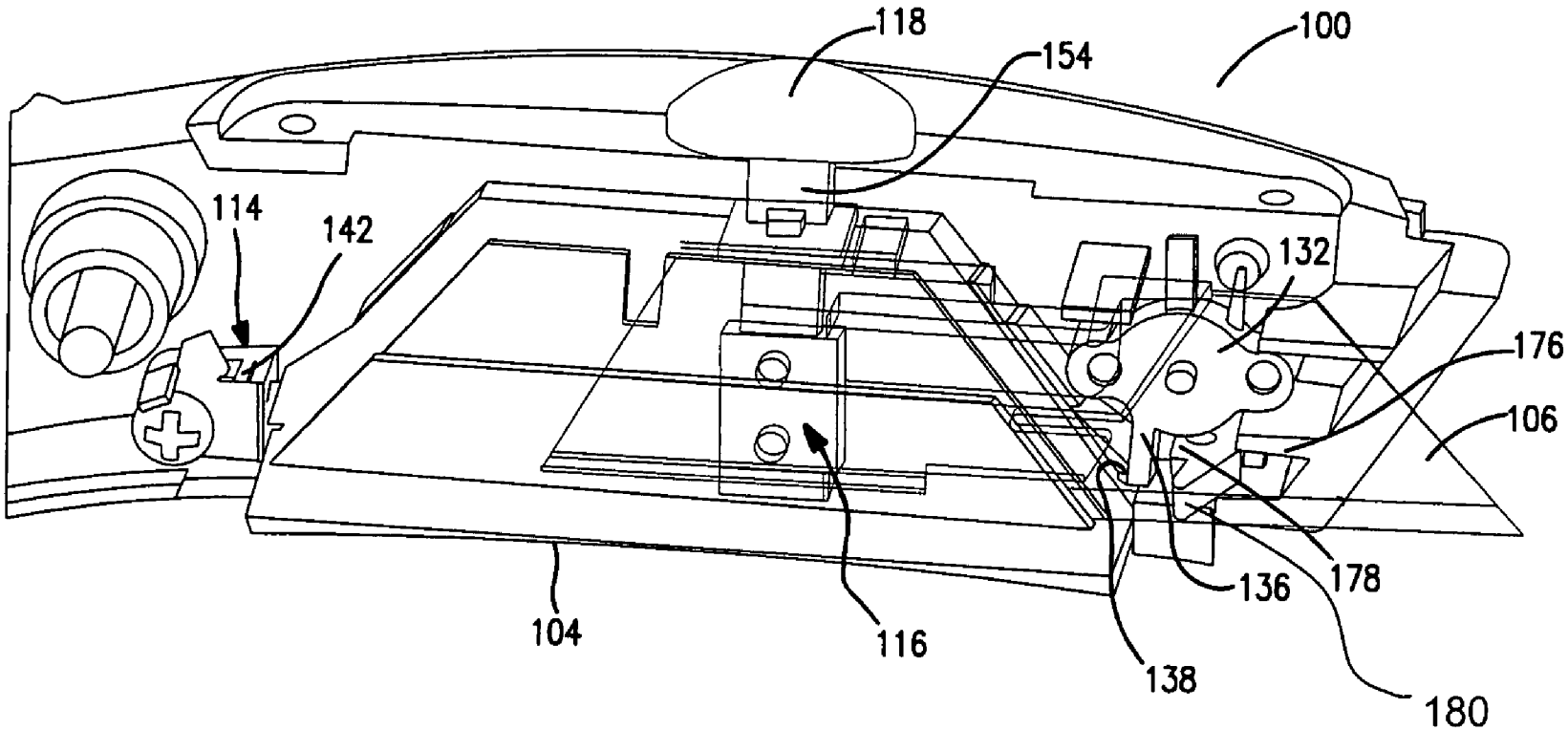
FIG. 15 is a view similar to FIG. 14 , but showing the thumb button and blade carrier being moved into the extended position.

As shown in FIG. 16, when the blade carrier 116 is in its forward position and the blade 126 extends from the front of the knife body 110, the upstanding portion 168 of the rear blade engaging tab 164 is in a position to be engaged by an inner extension 170 of the side release button 146 as shown in FIG. 15. With this arrangement, depressing the release button 146 will cause the tabs 162 and 164 to be disengaged from the notches 120 in the blade 106 so that the blade 106 may be removed from the knife body 100 by grasping the blade 106 and pulling it away from the knife body 100.

The front and rear cartridge catches 112 and 114 are adapted to be rendered unreleaseable when the blade carrier 116 is in the forward position and a blade is positioned for cutting. In this connection, as shown particularly in FIG. 13, the rear cartridge catch 114 includes a pivotably mounted locking block 172 having an arm 174. The locking block 172 is spring biased into a position behind the locking slide 142 wherein it will prevent moment of the locking slide 142 away from the tab 110 on the cartridge 106. The arm 174 on the locking block 172 is positioned to be engaged by the bracket 158 of the blade carrier 116 when the blade carrier 116 is in its retracted position to pivot the locking block 172 out of blocking engagement with the locking slide 142.

As shown in FIGS. 14 and 15, the front cartridge catch 112 includes a security lock 176 which is pivotally mounted for rotation about an axis perpendicular to the axis of rotation of the pivotable member 132. The security lock 176 is positioned below the axis of the pivotable member 132 and includes a locking portion 178 which, when rotated into position in front of the downwardly extending arm 136 on the pivotable member 132, prevents the downwardly extending arm 136 and hook 138 from being able to pivot out of engagement with the front tab 108 on the cartridge 104. When the locking potion 178 is pivoted away from in front of the downwardly extending arm 136, there is a gap sufficient for the downwardly extending arm 136 and hook 138 to pivot out of engagement with the front tab 108. The security lock 176 includes a contact arm 180 which extends in a position to be engaged by a blade 106 as the blade 106 is being moved into its extended position. The engagement of the contact arm 180 by the blade 106 serves to pivot the security lock 176 into a position where the locking portion 178 blocks the downwardly extending arm 136.

With the above described arrangement, the cartridge 104 will be releasably held in place within the knife body 100, and releasable when the blade carrier 116 is in its retracted position and the release button 146 is depressed. When the thumb button 118 moves the blade carrier 116 into its extended position to expose the knife blade 106, the cartridge 104 is rendered unreleaseable even if the release button 142 is depressed. The side release button 146, which will enable removal of the magazine when depressed and the blade carrier 116 is in its retracted position, also serves to release the blade 106 from the blade carrier 116 to permit removal of a used blade from the knife body when the blade carrier 116 is in its extended position.

Referring to FIGS. 17*a-d* there is shown a hobby knife 200 incorporating a removable blade cartridge 202: The hobby knife 200 includes an elongated body 204 of generally circular cross-section and provided with a blade opening 206 at its front end. A gripping portion 208 is provided adjacent the front end and includes a bottom opening 210 for the reception of the cartridge 202. The cartridge 202 is adapted to hold five to six blades 212, but other quantities are possible. The blades 212 are generally triangular in configuration with a rearward extending tail portion 214 having a slot 216 therein. The outer surface 217 of the cartridge 202 is arcuate in cross section and provides a generally continuous circular surface in cross section with the body 204 when inserted into the opening 210.

Figure 17A:
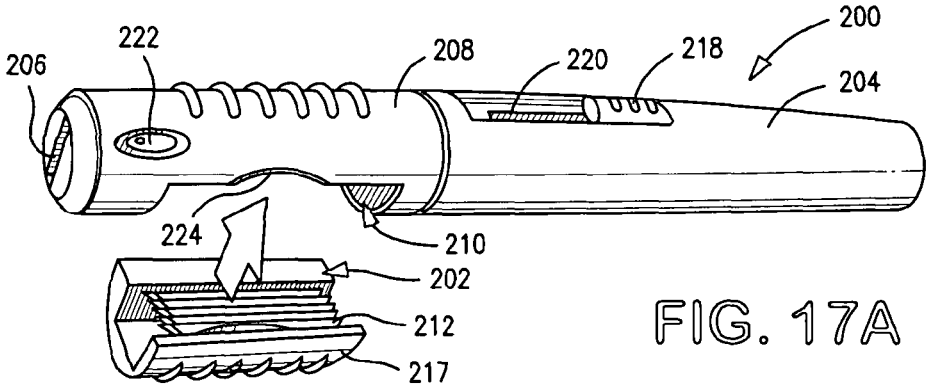
FIGS. 17*a-d* are side views of the various stages of a hobby knife having a removeable blade cartridge.
Figure 17B:
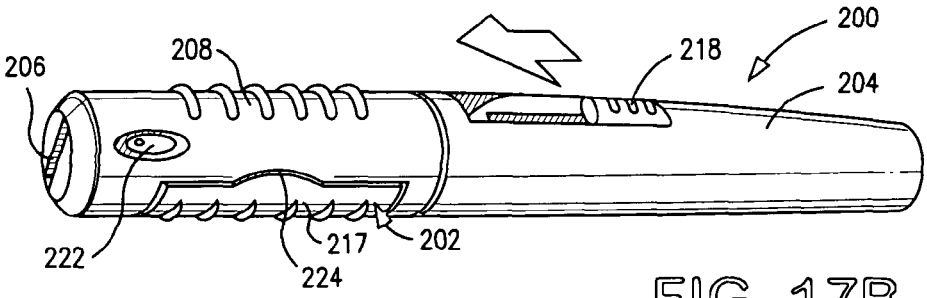
Figure 17C:
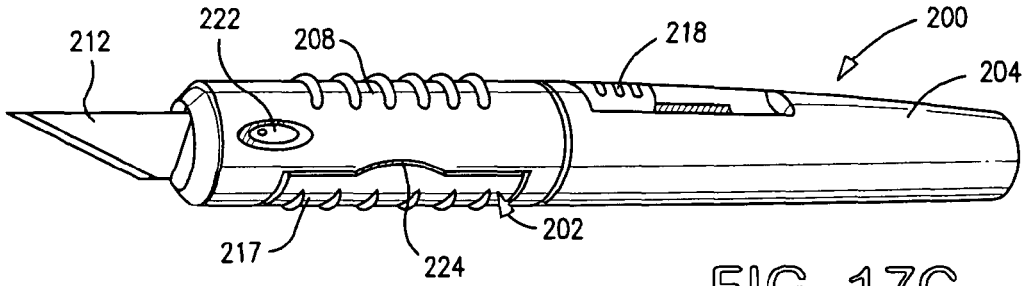

The cartridge 202 is inserted into the opening 210 in the bottom of the gripping portion 208 as shown in FIG. 17*a* and is releaseably held in position by suitable latches (not shown). A thumb button 218 extends through a slot 220 in the body 204 of the knife 200 and is attached to a blade carrier (not shown). The blade carrier is adapted to engage with the slot 216 in the tail portion 214 of a blade 212. As shown in FIGS. 17*b* and 17*c*, the thumb button 218 is moved forwardly into its forward position to extend the blade 212 into its cutting position.

Figure 17D:
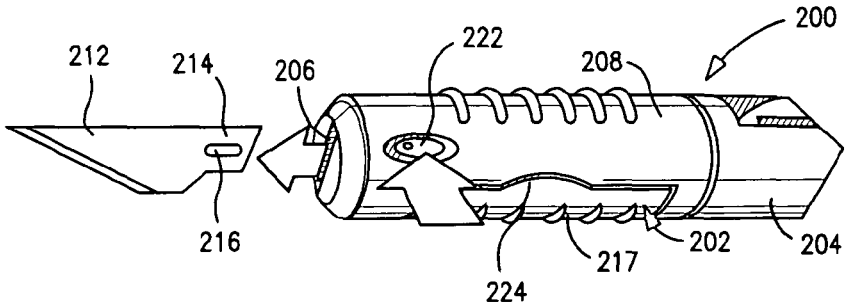

A release button 222 is provided in the side of the body 204. When the blade 212 is in its extended cutting position, depressing the release button 222 as shown in FIG. 17*d* will permit the blade 212 to be separated from the blade carrier and removed from the knife 200. The release button 222 will also permit release of the cartridge when the thumb button 218 is moved into its retracted position. The body 204 is provided with arcuate depressions 224 adjacent the opening 210 to provide finger access for grasping the cartridge 202 when it is desired to remove it.

FIGS. 18*a-d* show a trimmer 250 of the type adapted to be moved along an arm 252 to trim sheets of paper. The trimmer 250 includes a head member 254 mounted for reciprocal movement on the arm 252. The head member 254 includes a body 256 having an opening 258 in its top surface 260 for the reception of a blade cartridge 262 holding a plurality of blades 264. The opening 258 is surrounded by a lip 266 that extends over the side of the body 256 as shown. One side wall 268 of the body 256 is adapted to ride between the two rails 270 and 272 of the arm 252 while the outer side wall 274 is adapted to be positioned on the outside of the arm 252.

The cartridge 262 includes a top surface 276 coextensive with the top surface 260 of the body 256 including the ribs 278. The top surface 276 of the cartridge 262 includes a tongue 280 extending from the side of the cartridge 262 and adapted to be received within a slot 282 in the lip 266 on the head member 254. As the tongue 280 extends beyond the side of the body 256, the tongue 280 provides a finger hold for grasping the cartridge 262 to remove it from the body 256 of the head member 254. The cartridge 262 also includes a downwardly extending ear portion 284 on one side having an elongated opening 286 extending therethrough. The opening 286 provides access to the blades 264 for a blade carrier (not show) which is connected to a finger button 288 through an elongated slot 290 in the outer side 274 of the body 256 of the head member 254. The outer side wall 274 and front wall 292 of the body 256 of the head member 254 have a window 292 provided therein to view the number of blades 264 remaining in the cartridge 262 while the cartridge 260 is inserted in the body 256.

Figure 18A:
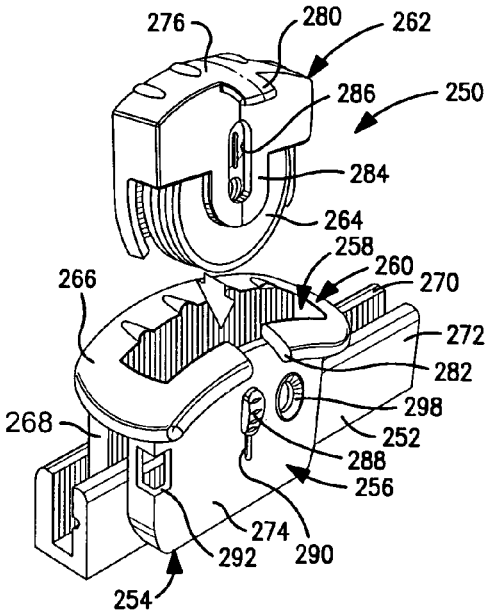
FIGS. 18*a-d* are isometric views of the various stages of a trimmer having a removeable blade cartridge.
Figure 18B:
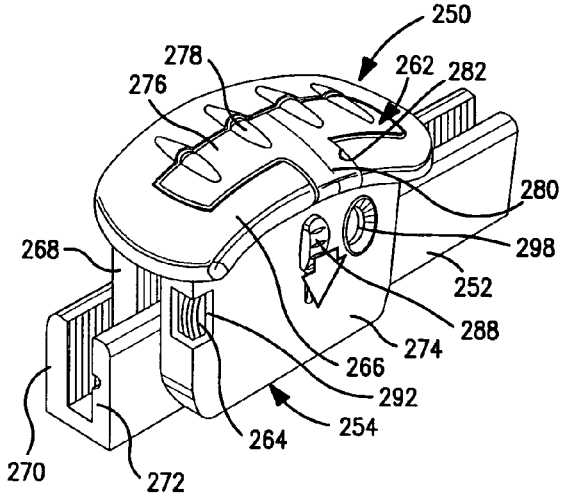
Figure 18C:
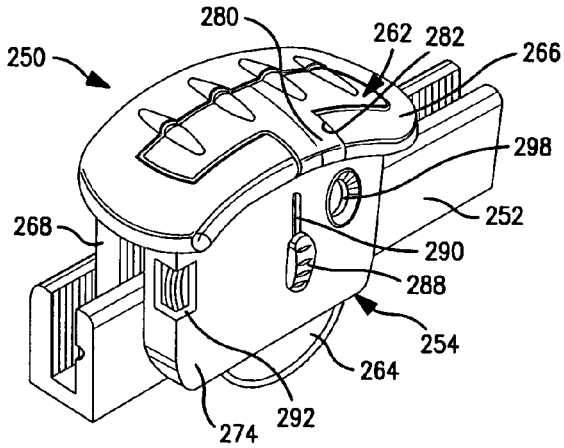
Figure 18D:
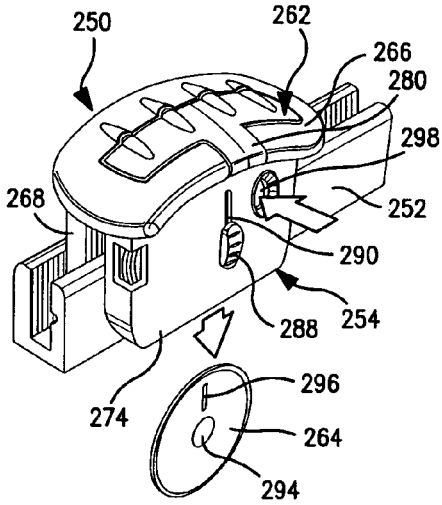

The blades 264 are circular with a cutting edge extending around their entire periphery. The blades 264 have a center aperture 294 and an elongated slot 296 as shown. When the cartridge 262 is inserted into the head member 254, the blades 264 are positioned between the outside of the arm 252 and the inner surface of the outer side wall 274 of the body 256 of the head member 254. With the cartridge 262 inserted in the head member 254, the finger button 288 is moved downwardly as shown in FIGS. 18*b* and *c* to move. a blade into cutting position. A release button 298 is provided in the outer side wall 274 of the body 256 of the head member 254. When the blade is in its cutting position, depressing the release button 298 as shown in FIG. 18*d* will permit the blade 262 to be released from the blade carrier and removed from the head member 254. Depressing the release button 298 when the finger button 288 is in its retracted position will permit release of the cartridge 262.

While various embodiments have been shown and described, various modifications and substitutions may be made thereto. Accordingly, it is understood that the present embodiments have been described by way of illustration and not limitation.

What is claimed:

1. A utility knife comprising:

a body having a handle portion and a frontal opening for a blade and a receiving cavity opening through said body;

a cartridge containing a plurality of blades insertable into said receiving cavity, said cartridge having a front and a rearward tab;

a blade carrier manually operable for receiving a blade from said cartridge and moveable into an extended position to position said blade through said opening into a cutting position;

front and rearward cartridge catches adapted to releaseably engage said tabs to secure said cartridge in said body;

a side button mounted in said knife body, said side button operatively connected to said front cartridge catch to release said front catch from engagement with said cartridge when depressed; and a blocking element for each of said cartridge catches, said blocking elements being movable into position to prevent release of said cartridge catches from said tabs when said blade carrier is in its extended position.

2. The utility knife of claim 1 wherein said rear cartridge catch comprises a slide plate moveable into engagement with said rearward tab, and spring means urging said sliding plate into engagement with said tab.

3. The utility knife of claim 2 wherein said blocking element for said rear cartridge catch includes a locking block moveable between a first position blocking movement of said slide plate out of engagement with said tab and a second non-blocking position permitting movement of said slide plate out of engagement with said rearward tab.

4. The utility knife of claim 3 wherein said carrier has a portion engageable with said locking block to move said locking block into its second position when said carrier is retracted.

5. The utility knife of claim 4 further including spring means biasing said locking block into its first position.

6. The utility knife of claim 1 wherein said forward cartridge catch includes a pivotable member having an arm terminating in a hook, said hook adapted to engage said forward tab.

7. The utility knife of claim 6 wherein said forward cartridge catch further includes a spring member biasing said hook into engagement with said tab.

8. The utility knife of claim 6 wherein said blocking element for said forward cartridge catch includes a pivotally mounted security lock moveable between a first position wherein it blocks said arm of said pivotable member from being pivoted out of engagement with said tab and a second position wherein said arm can be pivoted out of engagement with said tab.

9. The utility knife of claim 8 wherein said security lock includes a contact arm adapted to be engaged by a blade to move said security lock into its first position as said blade is being moved into its extended position.

10. The utility knife of claim 9 wherein said pivotable member of said forward cartridge catch includes a second arm having an inclined surface thereon, said side button having an inwardly extending projection with a surface adapted to mate with said inclined surface on said arm whereby axial movement of said push button causes said pivotable member to rotate to disengage said hook with said tab.

11. A knife comprising:

a body having a handle portion and a frontal opening for a blade and a receiving cavity opening through said body;

a cartridge comprising a magazine of blades disposed in adjacent upright side-by-side relationship, each said blade defining a plane and having a lower cutting edge, and insertable in a direction parallel to said plane into said receiving cavity;

a carrier manually operable for receiving a blade from said received cartridge and positioning said blade for extension through said opening to present a cutting edge; and a button projecting through said body and manually depressable to release said blade from said carrier to permit withdrawal forwardly from said opening and said button being depressible to allow said cartridge to be withdrawn from said body.

12. The knife of claim 11 wherein said cartridge forms a receptacle for receiving a plurality of blades and said receptacle defines a detent which interacts to secure said cartridge to said body.

* * * * *